US009267082B2

(12) United States Patent
Braden et al.

(10) Patent No.: US 9,267,082 B2
(45) **Date of Patent: *Feb. 23, 2016**

(54) REMOVAL OF MERCURY AND MERCURIC COMPOUNDS FROM CRUDE OIL STREAMS

(71) Applicant: Nalco Company, Naperville (IL)

(72) Inventors: Michael L. Braden, Sugar Land, TX (US); Samuel A. Lordo, Richmond, TX (US)

(73) Assignee: NALCO COMPANY, Naperville, IL (US)

( * ) Notice: Subject to any disclaimer, the term of this patent is extended or adjusted under 35 U.S.C. 154(b) by 375 days.

This patent is subject to a terminal disclaimer.

(21) Appl. No.: 13/970,998

(22) Filed: Aug. 20, 2013

(65) Prior Publication Data

US 2013/0334102 A1 Dec. 19, 2013

Related U.S. Application Data

(63) Continuation of application No. 13/211,418, filed on Aug. 17, 2011, now Pat. No. 8,524,074.

(51) Int. Cl.

| | |
|---|---|
| ***C10G 53/02*** | (2006.01) |
| ***C10G 53/04*** | (2006.01) |
| ***C10G 29/28*** | (2006.01) |
| ***C10G 25/00*** | (2006.01) |
| ***C10G 29/20*** | (2006.01) |
| ***C10G 31/08*** | (2006.01) |

(52) U.S. Cl.

CPC ..... *C10G 25/003* (2013.01); *C10G 29/20* (2013.01); *C10G 31/08* (2013.01); *C10G 53/02* (2013.01); *C10G 2300/1044* (2013.01); *C10G 2300/201* (2013.01); *C10G 2300/202* (2013.01); *C10G 2300/205* (2013.01)

(58) Field of Classification Search

CPC ..... C10G 2300/1044; C10G 2300/201; C10G 2300/202; C10G 2300/205; C10G 25/003; C10G 29/20; C10G 31/08; C10G 53/02

See application file for complete search history.

(56) References Cited

U.S. PATENT DOCUMENTS 5,164,095 A * 11/1992 Sparapany ..... C02F 1/5272 210/735

6,537,443 B1 * 3/2003 Frankiewicz ..... C10G 25/003 208/251 R

* cited by examiner

*Primary Examiner* — Renee E Robinson
*Assistant Examiner* — Derek Mueller
(74) *Attorney, Agent, or Firm* — Benjamin E. Carlsen

(57) ABSTRACT

The invention is directed towards a method of removing mercury bearing species from a hydrocarbon containing fluid. The method comprises the steps of: i) adding dithiocarbamate polymer to the fluid in an amount such that the number of mercury bonding sites on the polymer exceeds the amount of mercury atoms by at least 10% and ii) removing the mercury bearing dithiocarbamate polymer with a water/oil separation device. The invention relies upon an unexpected reversal in the solubility of dithiocarbamate polymer at very high concentrations. Because of the high solubility the polymer remains within the water phase of the hydrocarbon fluid and can be removed without the need for cumbersome precipitation methods and complicated solid liquid separation devices.

11 Claims, 1 Drawing Sheet

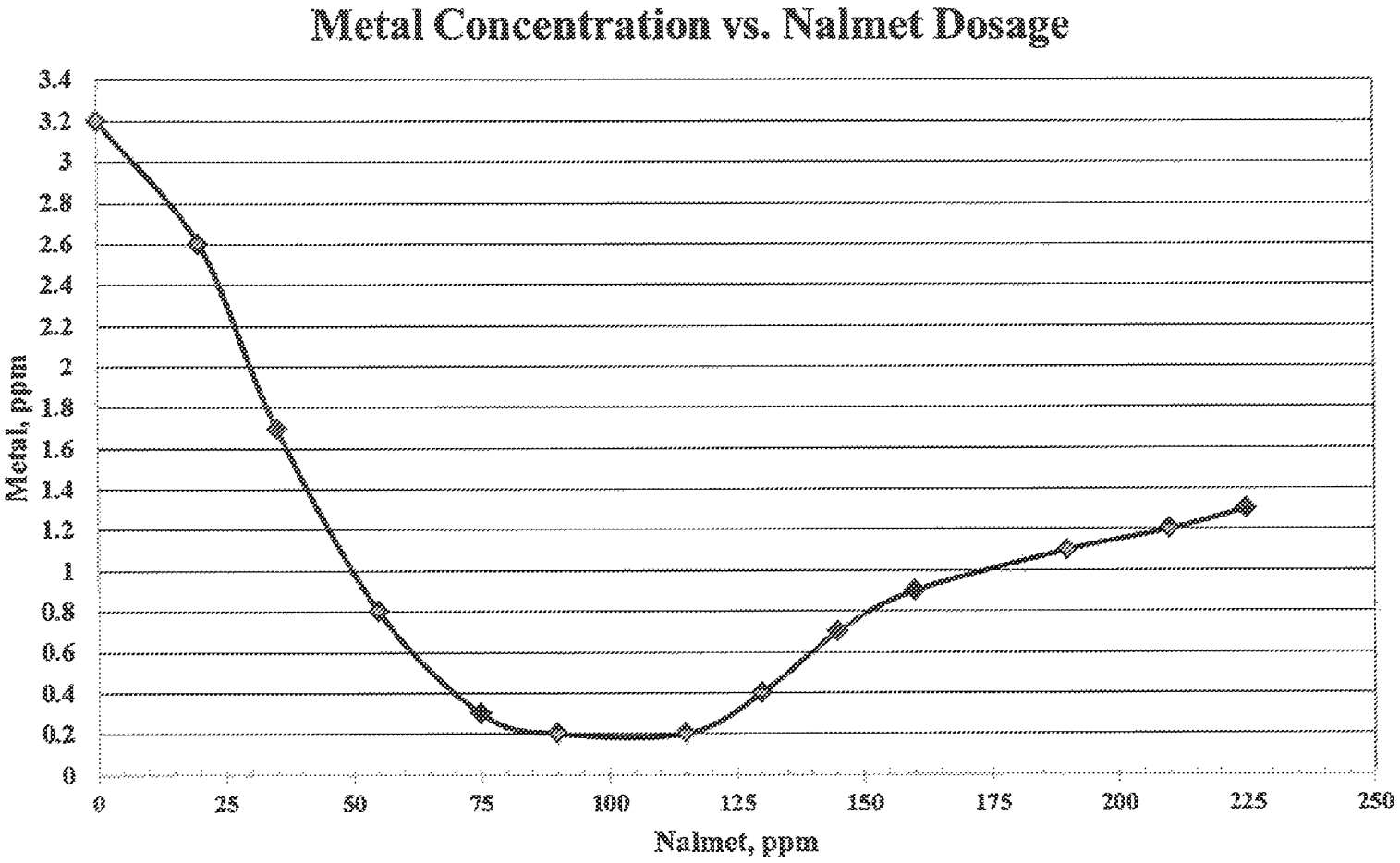
Metal Concentration vs. Nalmet Dosage
Metal, ppm
3.4
3.2
3
2.8
2.6
2.4
2.2
2
1.8
1.6
1.4
1.2
1
0.8
0.6
0.4
0.2
0
0
25
50
75
100
125
150
175
200
225
250
Nalmet, ppm

REMOVAL OF MERCURY AND MERCURIC COMPOUNDS FROM CRUDE OIL STREAMS

CROSS-REFERENCE TO RELATED APPLICATIONS

This is a continuation application of co-pending application Ser. No. 13/211,418 filed on Aug. 17, 2011.

STATEMENT REGARDING FEDERALLY SPONSORED RESEARCH OR DEVELOPMENT

Not Applicable.

BACKGROUND OF THE INVENTION

This invention applies to methods and compositions for the removal of mercury species from crude oil streams, hydrocarbons, and/or gas condensates using dithiocarbamates with or without electrostatic coalescence. In many forms of crude oil a variety of mercury-containing species are present. These include but may not be limited to elemental mercury, mercuric chloride, mercuric sulfide, mercuric selenide, and various combinations thereof. Also the mercury can be a chemical component of a variety of asphaltic and sulfur containing complexes and compounds. As an example, crude oils from the Austral Basin region of Argentina frequently contain well over 2000 ppb of mercury. Changes in the economics of the oil industry have resulted in such mercury bearing crude oils to be more commonly used.

It is important that these mercury-containing species be removed from the crude oil as they pose significant product quality and environmental and safety issues. As volatile compounds, the presence of mercury-containing species make processing and handling of the crude oil hazardous and unpredictable. Because the species are often toxic they render whatever hydrocarbons they end up in either unsafe to handle or beyond various established, safety, pollution, and/or legal standards. Also the species tend to have unwanted side reactions with various additives used in the refining process or used to enhance the performance of the final hydrocarbon product. For example mercury species are known to destroy hydrotreating and other catalysts used to make the oil refining process economical.

Mercury bearing species are particularly odious to naphtha. In the crude oil refining process, naphtha is produced as a fraction of a distillation step. Mercury bearing species congregate within this fraction resulting in naphtha that is concentrated with unwanted mercury. This greatly reduces the value and use of this naphtha.

Currently, adsorbents, gas stripping and chemical precipitation methods are being used to remove mercury from crudes and other hydrocarbon liquids prior to their processing in order to avoid catalyst poisoning problems. The use of fixed bed adsorbents, such as 30 activated carbon, molecular sieves, metal oxide-based adsorbents and activated alumina, to remove the mercury is a potentially simple approach but has several disadvantages. For example, solids in the crude oil tend to plug the adsorbent bed, and the cost of the adsorbent may be excessive when mercury levels are greater than 100 to 300 ppb. Also, large quantities of spent adsorbent are produced when treating hydrocarbon liquids having high levels of mercury, thereby making it imperative to process the spent adsorbent to remove adsorbed mercury before either recycle or disposal of the adsorbent.

Gas stripping also has drawbacks. To be effective the stripping must be conducted at high temperature with relatively large amounts of stripping gas. Since crudes contain a substantial amount of light hydrocarbons that are stripped with the mercury, these hydrocarbons must be condensed and recovered to avoid substantial product loss. Moreover, the stripping gas must either be disposed of or recycled, both of which options require the stripped mercury to be removed from the stripping gas.

Chemical precipitation includes the use of sodium sulfide or other sulfur containing compounds to convert mercury in the liquid hydrocarbons into solid mercury sulfide, which is then separated from the hydrocarbon liquids through filtration (U.S. Pat. No. 6,537,443). As taught in the prior art, this method requires significant volumes of aqueous sodium sulfide solutions to be mixed with the liquid hydrocarbons. The drawbacks of this requirement include the necessity to maintain significant volumes of two liquid phases in an agitated state to promote contact between the aqueous sodium sulfide solution and the hydrocarbon liquids, which in turn can lead to the formation of an oil-water emulsion that is difficult to separate.

U.S. Pat. Nos. 6,537,443 and 6,685,824 documents the use of polymeric dithiocarbamate, monomeric dithiocarbamates, sulfurized olefins, and diatomaceous earth or zeolites impregnated with sulfur bearing compounds to remove mercury bearing species. They add the sulfur-containing compounds to the hydrocarbon to form a solid sulfur-mercury complex that requires removal using a hydrocarbon-water separation step following filtration of the hydrocarbon. U.S. Pat. Nos. 7,341,667, 7,449,118, and 7,479,230 describe the use of used alumina to reduce the level of inorganic contaminants, such as mercury and arsenic, from waste fluid streams. The alumina in this process is used Claus catalyst, which is used to recover elemental sulfur from hydrogen sulfide in gases. The waste fluid streams are passed through a filter containing the used Claus catalyst removing both elemental and ionic mercury. U.S. Pat. No. 7,476,3659 discloses a method and apparatus to remove elemental mercury from natural gas by condensing the mercury and gas via a cooler. The elemental mercury is collected at the bottom of the vessel. None of these methods however allow for the mercury removal processes to occur with an in situ method using commonly available oilfield water/oil separation equipment or refinery water/oil equipment. As a result because they require additional cumbersome steps with more costly equipment they are unsatisfactory solutions to the problem. Thus there is clear utility in compositions, methods, and apparatuses that remove mercury species from crude oil streams, hydrocarbons, and/or gas condensates.

The art described in this section is not intended to constitute an admission that any patent, publication or other information referred to herein is "Prior Art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

At least one embodiment of the invention is directed towards a method of removing mercury bearing species from a hydrocarbon containing fluid. The method comprises the steps of: i) adding dithiocarbamate polymer to the fluid in an amount such that the number of mercury bonding sites on the polymer exceeds the amount of mercury atoms by at least 10% and ii) removing the mercury bearing dithiocarbamate polymer with only a water/oil separation device.

Mercury free water may be added to the fluid prior to adding the polymer. The polymer may be added to the mercury free water prior to adding the solution to the hydrocarbon. An emulsifier may be added to the fluid before adding the polymer. The emulsifier may be added to the added mercury free water. An emulsion breaker may be added to the hydrocarbon before or after adding the polymer to the washwater. The method may exclude the use of solid liquid separation device. The hydrocarbon may be a naphtha fraction formed by a distillation process of crude oil.

The mercury bearing species may be one selected from the list consisting of elemental mercury, mercuric chloride, mercuric sulfide, mercuric selenide, dimethylmercury, diethyl mercury, asphaltic and sulfur containing complexes and compounds, and combinations thereof. The method may further comprise the step of converting elemental mercury into charged mercury. The method may further comprise the use of an electrostatic device. The method may further comprises iii) mixing the liquid hydrocarbon with an organic compound containing at least one sulfur atom that is reactive with mercury, wherein said organic compound is not supported on carrier solids and is selected from the group consisting of sulfurized isobutylenes, dithiocarbamates, alkyl dithiocarbamates, polymeric dithiocarbamates, sulfurized olefins, thiophenes, mono and dithio organic acids, and mono and dithioesters; and iv) separating mercury-containing water-soluble complexes formed in step iii) by the reaction of said organic compound with mercury from the effluent of step iii) to produce liquid hydrocarbons having a reduced mercury concentration as compared to said liquid hydrocarbon feed.

Additional features and advantages are described herein, and will be apparent from, the following Detailed Description.

BRIEF DESCRIPTION OF THE DRAWINGS

A detailed description of the invention is hereafter described with specific reference being made to the drawings in which:

FIG. 1 is a graph showing the inventive method of overtreating the complexing agent to create a more water-soluble metal-polymer complex.

DETAILED DESCRIPTION OF THE INVENTION

The following definitions are provided to determine how terms used in this application, and in particular how the claims, are to be construed. The organization of the definitions is for convenience only and is not intended to limit any of the definitions to any particular category.

"Emulsion" means a liquid mixture in which a dispersed phase liquid, which is otherwise immiscible within a continuous phase liquid, is effectively distributed throughout the continuous phase liquid by means of some chemical and/or process.

"Mercury Bearing Species" means a composition of matter containing mercury in any form, and in any charged state, and which includes but is not limited to mercury connected by an ionic bond, covalent bond, polar association, steric entrapment, or otherwise associated with one or more components of the composition of matter.

"Surfactant" means a composition of matter characterized in being a surface active agent having an amphiphilic structure which includes a hydrophilic. head group and a hydrophobic tail group and which lowers the surface tension of a liquid, the interfacial tension between two liquids, or that between a liquid and a solid.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims.

In at least one embodiment a process is used for treating a mercury-contaminated hydrocarbon to remove at least some of the mercury. It will be understood that, although crude oil is often described as the feedstock being treated to remove mercury, the process can be used to treat any hydrocarbons that are liquid at ambient conditions (or higher or lower temperatures) or up to temperatures of 300° F. (or higher or lower) and contain undesirable amounts of mercury. Examples of such liquid hydrocarbons include but are not limited to naphtha, kerosene, gas oils, atmospheric residues, natural gas condensates, liquefied natural gas, and combination thereof. In at least one embodiment the process is used to treat a hydrocarbon feedstock containing more than 10 ppb mercury and is effective for treating feeds containing more than 50,000 ppb mercury. When the feedstock is a natural gas condensate, may contain between about 25 and about 3000 ppb mercury, usually between about 50 and about 1000 ppb. Typical crude oils fed to the process of the invention have mercury levels ranging from about 100 to about 25,000 ppb mercury and quite frequently contain between about 200 and about 2500 ppb mercury.

In at least one embodiment mercury bearing species are removed from a hydrocarbon fluid according to a process in which at least one dithiocarbamate polymer is added to the hydrocarbon fluid, the at least one dithiocarbamate polymer is added in an amount such that the number of mercury bonding sites on the polymer exceeds the amount of mercury atoms by at least 10% and removing the mercury bearing dithiocarbamate polymer with a water/oil separation device.

The effectiveness of this process is quite unexpected. U.S. Pat. No. 6,537,433 teaches a number of methods and processes (all of which are incorporated by reference in their totality) for utilizing dithiocarbamate polymers to remove mercury. Common to all of those methods is the knowledge that increasing the amount of dithiocarbamate polymer results in a greater reduction in the solubility of the polymer and therefore requires the use of a solid/liquid separation device. It was quite unexpected that if dithiocarbamate polymer is added far beyond its stoichiometric ratio to mercury that it would continue to be effective but would increase the water solubility of the metal-dithiocarbamate polymer complex. Without being limited to theory and in particular in the construal of the claims, it is believed that when the bonding sites on the polymer exceeds the amount of mercury atoms by at least 10% these site form hydrogen bonds with the water and return to solubility in the water phase. As a result, cumbersome solid/liquid separation devices are not required. In at least one embodiment the process excludes the use of a solid liquid separation device. In at least one embodiment the process excludes the use of a solid liquid separation device with hydrocarbons containing more than 10 ppb mercury. The unexpected increase in solubility resulting from overdosing is illustrated in FIG. 1.

In at least one embodiment water is removed from a hydrocarbon containing fluid taking mercury with it before the dithiocarbamate polymer is added. This can be accomplished with an oil/water separation device. In at least one embodiment water constitutes 0.1 to 0.5% of the hydrocarbon containing fluid after the water is removed.

In at least one embodiment mercury free water is added to the hydrocarbon increasing the solubility of the mercury in the water before the dithiocarbamate polymer is added. In at least one embodiment the additional water results in water comprising up to 3-8% (and preferably about to equal to 5%) of the hydrocarbon containing fluid.

In at least one embodiment an emulsifier is added to the hydrocarbon. This increases the tendency of the mercury to encounter and interact with the dithiocarbamate polymer. In at least one embodiment an emulsion breaker is added after the mercury has interacted with the dithiocarbamate polymer to facilitate the oil/water separation step.

In at least one embodiment the process is conducted at the desalting step of a refinery process. Crude oil desalting is a method where the water-in-oil emulsion is first intentionally formed. Water is added in an amount of approximately between 3% and 10% by volume of crude. The added water is intimately mixed with the crude oil to contact the impurities therein, thereby transferring these impurities into the water phase of the emulsion. The emulsion is usually resolved with the assistance of emulsion breaking chemicals, which are characteristically surfactants, and by the known method of providing an electrical field to polarize the water droplets. Once the emulsion is broken, the water and petroleum media form distinct phases. The water phase is separated from the petroleum phase and subsequently removed from the desalter. The petroleum phase is directed further downstream for processing through the refinery operation. In at least one embodiment this process can be utilized in a water hydrocarbon separator that does not utilize electrostatic coalescence. In at least one embodiment the residence time of the polymer with the mercury bearing species is between 10 minutes to 1 week. In at least one embodiment the residence time is as short as a fraction of a second or a few seconds.

In at least one embodiment water wash is added to the incoming crude oil (which may be in an amount equal to three to ten percent of the crude oil) and is mixed (via emulsification, vigorous mixing, or any equivalent known in the art), and using water-in-oil emulsions breakers to help quickly separate the oil and water phases in the desalter quiet zone. Adding the excessively dosed polymeric dithiocarbanate to the water wash, a complex of the mercury and p-DTC will occur. This complex is water-soluble and will transport the mercury from the oil phase to the water phase, thus improving downstream operations.

Often, the crude oil is contaminated with dissolved elemental mercury, mercury-containing colloidal particles and/or droplets, and solids on which mercury has been adsorbed. The latter solids are typically comprised of reservoir solids, such as sand and clays, and carbonate particulates that precipitate as the crude oil is produced. The mercury-contaminated solids and colloidal mercury particles are preferably removed prior to treating the crude to remove, the dissolved mercury.

In at least one embodiment materials and processes are used to convert elemental mercury into charged mercury and thereby increase the increase the interactions between the dithiocarbamate polymer and the mercury.

EXAMPLES

The foregoing may be better understood by reference to the following examples, which are presented for purposes of illustration and are not intended to limit the scope of the invention.

A seven-gallon sample in a stainless steel container of crude oil was received from an oil refinery. The sample was a solid at room temperature. The sample was melted and poured into 7 one-gallon containers. The oil was melted and either 90 or 80-mL was poured into prescription bottles. 10 or 20-mL of distilled water was added to bring the total volume to 100-mL. To some of the bottles, 6 ppm and 60 ppm (of the total oil volume) of ditiocabamate polymer (NALMET VX7928 or N-8154, from Nalco Company) was added. To all the bottles, 25 ppm of emulsion breaker (EC2425A from Nalco Company) was added to resolve the emulsion after agitation. The samples were shaken 200 times and placed in a 90 degrees C. water bath for one hour to separate the oil and water phases. After the water and oil were separated, an aliquot of 20 mL of the crude oil was taken from the middle of the oil layer for mercury measurements. The results are shown in Tables 1 and 3. The crude oil contained 1034 parts per billion (ppb). Water alone removed 75-78% of the mercury and left an average of 245 ppb mercury in the oil phase. Using 6 ppm of NALMET VX7928, 81% of the mercury was removed to the water phase leaving 193 ppm of Hg in the crude oil. This is an additional 52 ppb or 5% extra removal rate. With 60 ppm NALMET VX7928, 87% of mercury was removed with 133 ppm mercury remaining with the oil.

TABLE 1

| Sample | Washwater % | VX7928 ppm | Mercury ppb | % Removal |
|---|---|---|---|---|
| Blank | 0 | 0 | 1034 | |
| 1 | 10 | 0 | 231 | 78 |
| 2 | 20 | 0 | 260 | 75 |
| 3 | 10 | 6 | 205 | 80 |
| 4 | 20 | 6 | 182 | 82 |
| 5 | 10 | 60 | 133 | 87 |

Testing was then conducted within an actual oil refinery on fresh crude. The crude contained 635 ppb mercury and washing the crude with DI water only removed 18.7% of the mercury as shown in Table 2. This removal percentage is very different the results obtained in the laboratory where 78% removal efficiency was measured. Testing with increasing amounts of VX7928 showed that 72% of the mercury was removed. This difference is presumed to be the result of more of the mercury at the refinery being in the form of elemental mercury.

TABLE 2

Refinery results

| Sample Name | VX7928 (ppm) | Hg content (ppb) | % Removal |
|---|---|---|---|
| Blank | | 635 | |
| Blank washed with 10 mL DI Water | 0 | 516 | 18.74 |
| Blank washed with 12 ppm VX7928 - 10 mL | 12 | 739 | −16.38 |
| Blank washed with 25 ppm VX7928 - 10 mL | 25 | 677 | −6.61 |
| Blank washed with 50 ppm VX7928 - 10 mL | 50 | 250 | 60.63 |

TABLE 2-continued

| Refinery results | | | |
|---|---|---|---|
| Sample Name | VX7928 (ppm) | Hg content (ppb) | % Removal |
| Blank washed with 0 ppm VX7928 - 10 mL | 0 | 522 | 17.8 |
| Blank washed with 75 ppm VX7928 - 10 mL | 75 | 239 | 54.49 |
| Blank washed with 100 ppm VX7928 - 10 mL | 100 | 228 | 64.09 |
| Blank washed with 150 ppm VX7928 - 10 mL | 150 | 178 | 71.97 |

Portable electric desalter (PED) tests were conducted to determine if the addition of NALMET VX7928 to the desalter washwater would have any negative effects on desalter performance. As shown in Table 3, NALMET VX7928 was added to the washwater at various dosages. The washwater content was 5% with 95% crude. The samples were heated to 90 degrees C. in a water bath, then each sample was emulsified for ten seconds at 80% variac power. The emulsion was poured into a PED tube and the electrode attached.

The PED tubes were placed in the heating block and heated to 120 degrees C. After five minutes the amount of water dropping out of the emulsion was measured with any rag layer at the oil/water interface. Readings were taken every five minutes. After seven minutes, a 500-volt shock for one minute was given to the emulsion and at 17 minutes, 3000-volt shock was used.

As can be seen from Table 3, the NALMET VX7928 additive did not have any effects on the resolution of the emulsion. All samples—except for the blank with no chemical addition—had the same water drop and no rag layer at the oil/water interface.

TABLE 3

| Crude PED Test: 15 ppm EC2425A, Various ppm VX7928 | | | | | | |
|---|---|---|---|---|---|---|
| | PERCENT WATER SEPARATION AT TIME (min) INDICATED: | | | | | |
| | 5 | 10 | 15 | 20 | 30 | 40 |
| Blank | 5 | 12.5 | 17.5 | 37.5 | 45 | 52.5 |
| VX7928 - 0 ppm | 10 | 22.5 | 37.5 | 70 | 87.5 | 90 |
| VX7928 - 12 ppm | 10 | 25 | 40 | 70 | 85 | 90 |
| VX7928 - 18 ppm | 10 | 27.5 | 42.5 | 75 | 87.5 | 92.5 |
| VX7928 - 24 ppm | 10 | 25 | 40 | 72.5 | 87.5 | 90 |
| VX7928 - 36 ppm | 10 | 22.5 | 42.5 | 72.5 | 90 | 90 |
| VX7928 - 60 ppm | 10 | 27.5 | 37.5 | 75 | 85 | 90 |
| VX7928 - 120 ppm | 10 | 27.5 | 40 | 75 | 87.5 | 90 |

4 mL water, 76 mL crude oil; 90° C., 10 sec @ 80% Power 500 volts for 1 minute at T = 7 minutes; 3000 volts for 1 minutes at T = 17 minutes While this invention may be embodied in many different forms, there are described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Additionally, the invention also encompasses any possible combination of some or all of the various embodiments described and incorporated herein. Furthermore the invention also encompasses combinations in which one, some, or all but one of the various embodiments described and/or incorporated herein are excluded.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g., 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method of removing mercury bearing species from a hydrocarbon containing water bearing fluid, the method comprising the steps of: adding dithiocarbamate polymer to the fluid in an amount such that the number of mercury bonding sites on the polymer exceeds the amount of mercury atoms by an amount such that the bonding sites form hydrogen bonds with the water and thereby render the polymer soluble in water; and removing the mercury bearing dithiocarbamate polymer with a water/oil separation device.

2. The method of claim 1 further comprising the step of adding mercury free water to the fluid prior to adding the polymer.

3. The method of claim 1 further comprising adding an emulsifier to the fluid before adding the polymer.

4. The method of claim 3 further comprising adding an emulsion breaker to the fluid after adding the polymer.

5. The method of claim 1 excluding the use of solid liquid separation device.

6. The method of claim 1 in which the hydrocarbon is a naphtha fraction formed by a distillation process of crude oil.

7. The method of claim 1 in which the mercury bearing species is one selected from the list consisting of elemental mercury, mercuric chloride, mercuric sulfide, mercuric selenide, asphaltic and sulfur containing complexes and compounds, and combinations thereof.

8. The method of claim 1 in which the number of mercury bonding sites exceeds the number of mercury atoms by at least 30%.

9. The method of claim 1 in which a conversion is achieved by the use of an electrostatic device.

10. The method of claim 1 in which the method further comprises (a) mixing said hydrocarbon containing water bearing fluid with an organic compound containing at least one sulfur atom that is reactive with mercury, wherein said organic compound is not supported on carrier solids and is selected from the group consisting of sulfurized isobutylenes, dithiocarbamates, alkyl dithiocarbamates, polymeric dithiocarbamates, sulfurized olefins, thiophenes, mono and dithioorganic acids, and mono and dithioesters; and (b) separating mercury-containing water soluble complexes formed in step (a) by the reaction of said organic compound with mercury from the effluent of step (a) to produce liquid hydrocarbons having a reduced mercury concentration as compared to said hydrocarbon containing water bearing fluid.

11. The method of claim 1 in which the method further comprises (a) mixing said hydrocarbon containing water bearing fluid with a sufficient amount of an aqueous solution of a sulfur-containing compound selected from the group consisting of alkali metal sulfides, alkaline earth metal sulfides, alkali metal polysulfides, alkaline earth metal polysulfides, and alkali metal trithiocarbonates such that the resultant mixture contains a volume ratio of said aqueous solution to said liquid hydrocarbon feed less than 0.003; and (b) separating mercury-containing water-soluble complexes formed in step (a) from the effluent of step (a) to produce liquid hydrocarbons having a reduced mercury concentration as compared to said hydrocarbon containing water bearing fluid.

* * * * *